US007081603B2

(12) United States Patent
Hoh et al.

(10) Patent No.: US 7,081,603 B2
(45) Date of Patent: Jul. 25, 2006

(54) COMPOSITE COOKING APPARATUS

(75) Inventors: Jung Eui Hoh, Suwon-si (KR); Jun Young Lee, Yongin-si (KR); Dong Lyoul Shin, Suwon-si (KR); Ha Yeong Yang, Suwon-si (KR); Jong Gun Kim, Hwasung-si (KR); Alexandr Narbut, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/878,062

(22) Filed: Jun. 29, 2004

(65) Prior Publication Data

US 2005/0115958 A1 Jun. 2, 2005

(30) Foreign Application Priority Data

Nov. 29, 2003 (KR) ..... 10-2003-0085929

(51) Int. Cl.
*H05B 6/12* (2006.01)

(52) U.S. Cl. ..... 219/601; 219/620; 219/622; 219/443.1; 219/452.11

(58) Field of Classification Search ..... 219/620–627, 219/601, 677, 680, 443.1–452.13; 392/422–431
See application file for complete search history.

(56) References Cited

U.S. PATENT DOCUMENTS

| | | | | |
|---|---|---|---|---|
| 3,979,572 | A | 9/1976 | Ito et al. | |
| 4,468,548 | A * | 8/1984 | Yamaki | 219/601 |
| 5,687,642 | A | 11/1997 | Chao | |
| 6,492,622 | B1 * | 12/2002 | Melson et al. | 219/452.11 |

FOREIGN PATENT DOCUMENTS

| | | | | |
|---|---|---|---|---|
| GB | 2 228 732 | * | 9/1990 | 392/411 |
| JP | 2-213086 | * | 8/1990 | 219/622 |

* cited by examiner

*Primary Examiner*—Philip H. Leung
(74) *Attorney, Agent, or Firm*—Staas & Halsey LLP

(57) ABSTRACT

A composite cooking apparatus having a body, a heating unit, an induction heating unit, and an insulating plate. The heating unit is positioned in the body to generate heat used to heat food. The induction heating unit is positioned adjacent to the heating unit to generate a magnetic field to cook the food by induction heating. The insulating plate is positioned between the heating unit and the induction heating unit to prevent heat generated from the heating unit from being transmitted to the induction heating unit. Further, the insulating plate is provided with at least one heat reflecting layer to reflect the heat generated from the heating unit.

20 Claims, 3 Drawing Sheets

COMPOSITE COOKING APPARATUS

CROSS-REFERENCE TO RELATED APPLICATIONS

This application claims the benefit of Korean Patent Application No. 2003-85929, filed Nov. 29, 2003 in the Korean Intellectual Property Office, the disclosure of which is incorporated herein by reference.

BACKGROUND OF THE INVENTION

1. Field of the Invention

The present invention relates, in general, to composite cooking apparatuses, and more particularly, to a composite cooking apparatus that includes an insulating plate with a heat reflecting layer formed thereon is installed between a planar heating element and a work coil, thus improving an insulating effect.

2. Description of the Related Art

Generally, an electronic cooking apparatus that performs cooking using electromagnetic induction heating applies a magnetic force to a cooking container, and then performs cooking using heat generated from the cooking container due to the applied magnetic force. The electronic cooking apparatus generates heat using a magnetic field, so that it may perform cooking without generating air pollution. Further, the electronic cooking apparatus typically has thermal efficiency of about 80% or above, so that it is an excellent cooking machine in an aspect of energy efficiency.

A conventional electronic cooking apparatus typically includes a work coil, to which a current is supplied to generate a magnetic field, an upper plate placed on the work coil to allow a cooking container to be seated thereon, and a ferrite plate placed below the work coil to allow lines of a magnetic force to pass therethrough.

In the conventional electronic cooking apparatus having the above construction, when a current is supplied to the work coil, a magnetic field is formed around the work coil. At this time, magnetic force lines forming the magnetic field form a closed loop that connects the upper plate, an inside of a bottom of the iron cooking container and the ferrite plate.

When the magnetic force lines formed in this way pass through the inside of the bottom of the iron cooking container, an eddy current is generated in the cooking container, and heat is generated from the iron cooking container by an electrical resistance as the eddy current flows. Further, the heat generated from the iron cooking container is transmitted to food placed in the cooking container, and thus the food is cooked.

However, the conventional electronic cooking apparatus is problematic in that it performs cooking in an induction heating manner, so that only an iron container capable of executing induction heating can be used as a cooking container, and a non-iron container cannot be used as a cooking container.

Further, the conventional electronic cooking apparatus is problematic in that, when cooking is performed using only a work coil, a cooking time lengthens if an amount of food increases, so that the electronic cooking apparatus is not suitable for cooking a large amount of food.

SUMMARY OF THE INVENTION

Accordingly, it is an aspect of the present invention to provide a composite cooking apparatus that cooks by directly generating heat through a heating unit as well as by generating heat using induction heating, thus performing cooking regardless of materials of a cooking container.

It is another aspect of the present invention to provide a composite cooking apparatus, which simultaneously drives an induction heating unit and a heating unit when a large amount of food is cooked, thus quickly performing cooking.

It is a further aspect of the present invention to provide a composite cooking apparatus, in which a heat reflecting layer is positioned on an insulating plate to prevent the induction heating unit from being damaged due to heat generated from the heating unit, thus improving an insulating effect.

Additional aspects and/or advantages of the invention will be set forth in part in the description which follows and, in part, will be obvious from the description, or may be learned by practice of the invention.

The above and/or other aspects are achieved by providing a composite cooking apparatus, including a body, a heating unit positioned in the body to generate heat used to heat food, an induction heating unit positioned adjacent to the heating unit to generate a magnetic field used to cook the food by induction heating, and an insulating plate positioned between the heating unit and the induction heating unit to prevent heat generated from the heating unit from being transmitted to the induction heating unit.

The above and/or other aspects are also achieved by providing a composite cooking apparatus, including a body, a heating element placed in the body to generate heat used to heat food, a work coil disposed in the body to generate a magnetic field to cook the food by induction heating, an insulating plate disposed adjacent to the heating element to prevent heat generated from the heating element from being transmitted to the work coil, and a blowing fan to compulsorily move air through an air moving path positioned between the insulating plate and the work coil.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
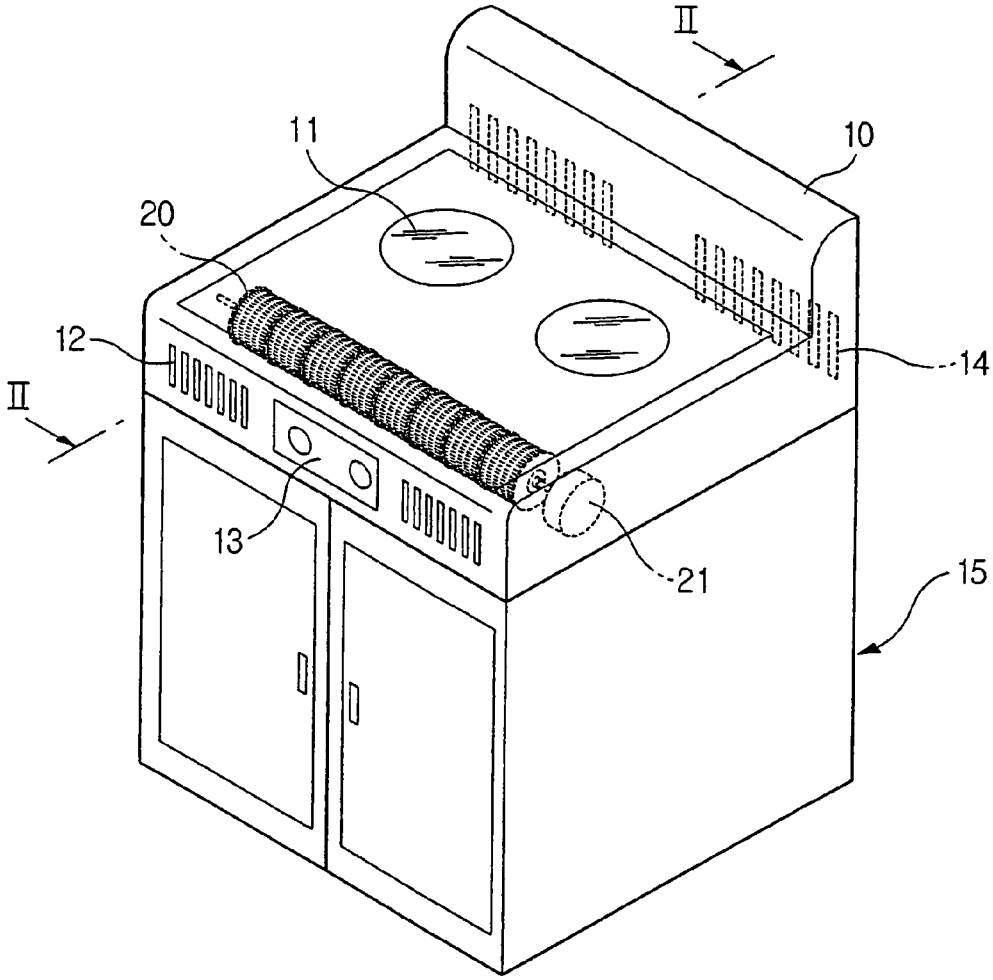
FIG. 1 is a perspective view showing an external shape of a composite cooking apparatus, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

As is shown in FIG. 1, a composite cooking apparatus, according to an embodiment of the present invention, includes a body 10 and heat resisting plates 11 placed on a portion of a top surface of the body 10 to allow various cooking containers to be seated thereon. An input unit 13 is placed on a center of a front surface of the body 10 to input operation commands to the composite cooking apparatus.

Inlets 12 are positioned in opposite sides of the input unit 13 to draw air used to disperse heat generated from a planar heating element (30 of FIG. 2), which will be described later, by allowing the air to move under an insulating plate (40 of FIG. 2), which will be described later.

Figure 2:
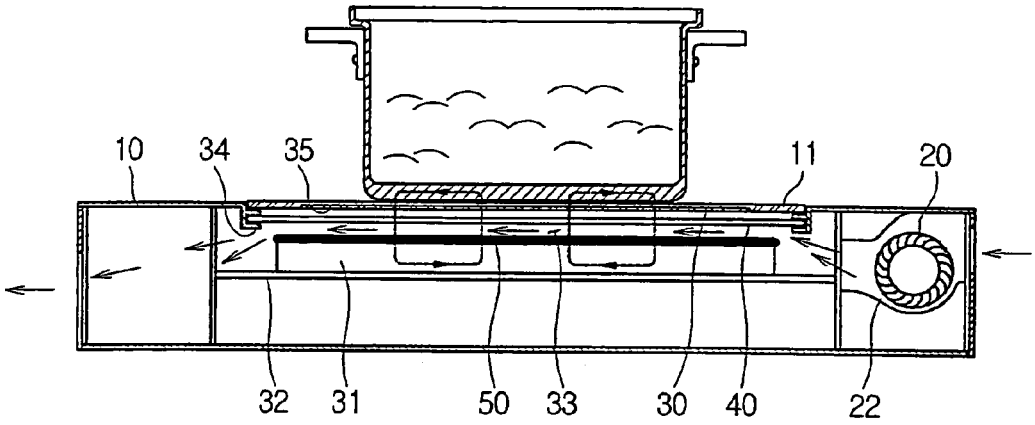
FIG. 2 is a sectional view taken along line II—II of FIG. 1.

A cylindrical blowing fan 20 is located in a front portion of an inside of the body 10 to compulsorily blow air drawn through the inlets 12 under the insulating plate (40 of FIG. 2). A fan motor 21 is provided at an end of the blowing fan 20 to rotate the blowing fan 20.

Outlets 14 are positioned in a rear surface of the body 10 to discharge air flowing under the insulating plate (40 of FIG. 2) to an outside of the body 10. An auxiliary cabinet 15, in which a receiving space is formed, is placed below the body 10.

The composite cooking apparatus of the present invention, constructed as shown in FIG. 2, is provided with the planar heating element 30, positioned below the heat resisting plate 11 while coming into contact with the heat resisting plate 11. The planar heating element 30 is a product, in which high-technology ceramic materials composed of fine particles, and conductive special carbon particles are uniformly distributed on fiber fabric, and which has a uniform heating density and a low power consumption.

When a current is supplied to the planar heating element 30, heat is generated from the planar heating element 30 and food is heated by the heat. In this way, the planar heating element 30 performs cooking by directly heating a cooking container.

The insulating plate 40 is placed below the planar heating element 30 to prevent the heat generated from the planar heating element 30 from being transmitted to a work coil 50, which will be described later. According to one aspect, the insulating plate 40 contacts the planar heating element 30. According to another aspect, the insulating plate 40 is spaced apart from the planar heating element 30 by a predetermined distance to improve an insulating effect. In this case, a spaced interval may be arbitrarily set in consideration of thermal efficiency and the insulating effect.

The insulating plate 40 is inserted into fixing members 34 extended from the top surface of the body 10. The planar heating element 30 is inserted into a groove 35 positioned in a central lower portion of the heat resisting plate 11, which is seated on tops of the fixing members 34.

The work coil 50 is placed below the insulating plate 40, spaced apart from the insulating plate 40 by a predetermined distance. In this case, the work coil 50 is formed in a shape in which a Litz wire is wound in a spiral form. Magnetic force lines generated from the work coil 50 pass through an inside of a bottom of the cooking container via the insulating plate 40 and the heat resisting plate 11.

A large amount of eddy current is generated inside the bottom of the cooking container due to the magnetic force lines, and heat is generated by an electrical resistance of the cooking container to the eddy current. In this way, the work coil 50 cooks food in an induction heating manner. Because the eddy current should be generated to cook food in the induction heating manner, it is not possible to perform cooking in the induction heating manner with a non-iron cooking container incapable of generating the eddy current.

A ferrite plate 31 is positioned below the work coil 50 while coming into contact with the work coil 50. Ferrite is a solid solution, in which impurities melt in iron having a body-centered cubic crystal structure, and which functions to shield the magnetic force lines generated from the work coil 50 by allowing the magnetic force lines to pass through the ferrite. Therefore, the magnetic force lines generated from the work coil 50 form a loop passing through the ferrite plate 31 placed below the work coil 50 after passing through the inside of the bottom of the cooking container via the insulating plate 40 and the heat resisting plate 11. A support 32 is placed below the ferrite plate 31 to support both the work coil 50 and the ferrite plate 31.

As noted previously, the insulating plate 40 and the work coil 50 are spaced apart from each other by the predetermined distance, so that an air insulating layer is formed in a space therebetween. In this case, to further improve an insulating effect, air is compulsorily moved through the air insulating layer. Therefore, according to one aspect the air insulating layer is mainly used as an air moving path 33.

According to one aspect the blowing fan 20 is placed on a right side of the air moving path 33 (as shown in FIG. 2), to compulsorily blow air into the air moving path 33. According to one aspect the blowing fan 20 is a multi-blade cross-flow fan, which provides air drawn through the inlets 12 to the air moving path 33. An air guiding member 22 is positioned around the blowing fan 20 to guide air blown by the blowing fan 20 to the air moving path 33.

Figure 3:
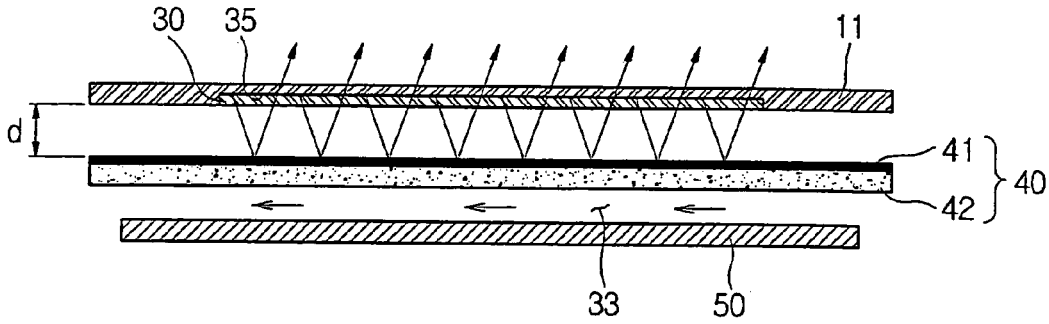
FIG. 3 is a sectional view showing an insulating plate of the composite cooking apparatus of FIG. 1.

As is shown in FIG. 3, the insulating plate 40 includes a base plate 42 and a heat reflecting layer 41 coated on a top surface of the base plate 42. Further, the insulating plate 40 is installed to be spaced apart from the planar heating element 30 by a predetermined distance d to effectively isolate heat transmitted from the planar heating element 30 by heat conduction.

According to one aspect, the base plate 42 of the insulating plate 40 is made of a packing-type insulating material. According to one aspect, the packing-type insulating material has air bubbles. According to another aspect, the packing-type insulating material is made of glass fiber containing asbestos fiber. According to yet another aspect, the packing-type insulating material is made of fireproof brick. According to another aspect, the base plate 42 is made of a material in which boron nitride is added to heat resisting plastic.

According to one aspect, a material with excellent heat reflectance is coated on the heat reflecting layer 41. Therefore, a material, such as a ceramic film, an aluminum oxide (Al203), or a beryllium oxide (BEO), may be used for the heat reflecting layer 41. A ceramic is an inorganic non-metal material made through heat-processing at high temperatures, and has high surface luminance, excellent heat resistance and excellent rub resistance. Therefore, when radiation heat generated from the planar heating element 30 comes into contact with the ceramic film coated on the insulating plate 40, the radiation heat is reflected due to the high surface luminance, so that it may be expected that the insulating effect be improved.

The aluminum oxide and the beryllium oxide are materials with high infrared reflectance. Even though the radiation heat generated from the planar heating element 30 is emitted in an infrared ray form, the radiation heat is reflected from an aluminum oxide layer or a beryllium oxide layer formed on the insulating plate 40, so that the heat is scarcely transmitted to the work coil 50. Moreover, infrared rays reflected from the aluminum oxide layer or the beryllium oxide layer are directed again to the cooking container. Therefore, although a same amount of energy is supplied, heat reaching the cooking container increases compared to a case where the aluminum oxide layer or the beryllium oxide layer is not used, thus obtaining additional effect, such as improvement of energy efficiency.

In this way, if the heat reflecting layer is positioned on the insulating plate, radiation heat is reflected close to total reflection even though the radiation heat is emitted from the planar heating element 30 at high temperatures (typically, 500° C. or above), thus obtaining a considerable insulating effect.

One of the ceramic film, the aluminum oxide layer and the beryllium oxide layer having high heat reflectance may be coated on the base plate 42. But according to one aspect, to obtain a superior insulating effect, a heat resisting plastic layer may be coated on the base plate 42 and a ceramic film layer may be positioned on the heat resisting plastic layer.

Further, it is also possible to coat a ceramic film layer on the base plate 42, and form either an aluminum oxide layer or a beryllium oxide layer on the ceramic film layer.

Hereinafter, an operation of the composite cooking apparatus of the present invention is described.

A user places a cooking container on the heat resisting plate 11 and then inputs an operation command to the composite cooking apparatus through the input unit 13. The operation command is then transmitted to a control unit (not shown). The control unit analyzes the operation command and then determines which of the planar heating element 30 and the work coil 50 to supply with a current.

If the input operation command requires operations of both the planar heating element 30 and the work coil 50, the control unit controls an inverter (not shown) to supply a current to both the planar heating element 30 and the work coil 50.

When the current is supplied to the planar heating element 30, a temperature of approximately 500° C. or greater is generated from the planar heating element 30 due to a resistance thereof. The resulting heat is transmitted to the cooking container placed on the heat resisting plate 11.

When a high-frequency current is supplied to the work coil 50, a magnetic field is formed around the work coil 50, so that an eddy current is formed in the cooking container due to the magnetic field. The eddy current generates heat according to an electrical resistance while passing through the cooking container. In this way, the heat generated from both the planar heating element 30 and the work coil 50 is transmitted to cook food.

A part of the heat generated from the planar heating element 30 is transmitted downward from the planar heating element 30 in a heat transmission manner using radiation. Heat radiant rays emitted downward from the planar heating element 30 reach the heat reflecting layer 41 of the insulating plate 40, and are reflected from the heat reflecting layer 41 directed upward from the insulating plate 40. Therefore, an insulating effect is further improved compared to a typical insulating plate.

While power is supplied to the planar heating element 30, the control unit moves air through the air moving path 33 by rotating the blowing fan 20, thus obtaining a superior heat isolating effect.

If sufficient heat is applied to the food and then the cooking has been completed, an OFF command is input by the user, and the controller receives the OFF command to shut off power supplied to both the planar heating element 30 and the work coil 50, thus terminating the cooking operation.

Through the above process, the operation of the present invention is terminated.

As is apparent from the above description, the present invention provides a composite cooking apparatus that cooks food by directly generating heat through a heating unit as well as by generating heat using induction heating, thus performing cooking regardless of the materials of a cooking container and quickly cooking a large amount of food.

Further, the present invention is advantageous in that a heat reflecting layer is formed on an insulating plate, thus preventing an induction heating unit from being damaged due to heat generated from a heating unit.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A composite cooking apparatus, comprising:

a body;

a planar heating unit positioned in the body to generate heat used to heat food;

an induction heating unit positioned in the body adjacent to the planar heating unit to generate a magnetic field to cook the food by induction heating; and an insulating plate positioned between the planar heating unit and the induction heating unit to prevent heat generated from the planar heating unit from being transmitted to the induction heating unit, wherein the planar heating unit comprises a planar heating element including ceramic particles and carbon particles distributed on a fiber fabric.

2. The composite cooking apparatus according to claim 1, wherein the insulating plate is provided with at least one heat reflecting layer to reflect the heat generated from the planar heating unit.

3. The composite cooking apparatus according to claim 2, wherein the at least one heat reflecting layer comprises a ceramic layer.

4. The composite cooking apparatus according to claim 3, wherein the at least one heat reflecting layer further comprises an aluminum oxide layer adjacent to the ceramic layer.

5. The composite cooking apparatus according to claim 3, wherein the at least one heat reflecting layer further comprises a beryllium oxide layer adjacent to the ceramic layer.

6. The composite cooking apparatus according to claim 2, wherein the at least one heat reflecting layer comprises a ceramic layer adjacent to a heat resisting plastic layer positioned on the insulating plate.

7. The composite cooking apparatus according to claim 1, wherein the insulating plate is spaced apart from the planar heating unit by a predetermined distance.

8. A composite cooking apparatus, comprising:

a body;

a planar heating element placed in the body to generate heat used to heat food;

a work coil disposed in the body to generate a magnetic field to cook the food by induction heating;

an insulating plate disposed adjacent to the heating element to prevent heat generated from the planar heating element from being transmitted to the work coil; and a blowing fan to compulsorily move air through an air moving path positioned between the insulating plate and the work coil, wherein the planar heating element comprises ceramic particles and carbon particles distributed on a fiber fabric.

9. The composite cooking apparatus according to claim 8, wherein the insulating plate is provided with at least one heat reflecting layer to reflect the heat generated from the planar heating element.

10. The composite cooking apparatus according to claim 9, wherein the at least one heat reflecting layer comprises a ceramic layer.

11. The composite cooking apparatus according to claim 10, wherein the at least one heat reflecting layer further comprises an aluminum oxide layer adjacent to the ceramic layer.

12. The composite cooking apparatus according to claim 10, wherein the at least one heat reflecting layer further comprises a beryllium oxide layer adjacent to the ceramic layer.

13. The composite cooking apparatus according to claim 9, wherein the at least one heat reflecting layer comprises a ceramic layer adjacent to a heat resisting plastic layer positioned on the insulating plate.

14. The composite cooking apparatus according to claim 8, wherein the insulating plate is spaced apart from the planar heating element by a predetermined distance.

15. The composite cooking apparatus according to claim 8, wherein the body is provided with at least one inlet to draw the air into the body and at least one outlet to discharge air moved through the air moving path to an outside of the body.

16. A composite cooking apparatus, comprising:

a first heating unit generating heat transferred to a cooking container; and a second heating unit, selectively generating a magnetic field, magnetic force lines of which pass through a bottom of the cooking container; and an insulating plate disposed between the first and second heating units to protect the second heating unit from the heat generated by the first heating unit, wherein the first heating unit comprises a planar heating element and is disposed in a fixed position on top of the second heating unit, and the planar heating element includes ceramic particles and carbon particles distributed on a fiber fabric.

17. The composite cooking apparatus according to claim 16, wherein the insulating plate comprises:

a base plate; and at least one heat reflecting layer.

18. The composite cooking apparatus according to claim 17, wherein the at least one heat reflecting layer has a high surface luminance.

19. The composite cooking apparatus according to claim 17, wherein the at least one heat reflecting layer has a high infrared reflectance.

20. A composite cooking apparatus, comprising:

a conduction heating unit;

an induction heating unit, the conduction and induction heating units being driven simultaneously to speed cooking; and an insulating plate disposed between the conduction and induction heating units to protect the induction heating unit from the heat generated by the conduction heating element, wherein the conduction heating unit comprises a planar heating element including ceramic particles and carbon particles distributed on a fiber fabric.

* * * * *